US005420764A

United States Patent [19]

Hussain et al.

[11] Patent Number: 5,420,764

[45] Date of Patent: May 30, 1995

[54] SOCKET/TAB SUPPORTED LIGHT FIXTURE

[75] Inventors: Syed M. A. Hussain, Diamond Bar; Wasif A. Siddiqui, San Dimas, both of Calif.

[73] Assignee: American Power Products, Inc., Chino, Calif.

[21] Appl. No.: 92,591

[22] Filed: Jul. 16, 1993

[51] Int. Cl.[6] ..... F21L 3/00

[52] U.S. Cl. ..... 362/95; 362/226; 362/260; 362/359

[58] Field of Search ..... 362/95, 226, 260, 322, 362/351, 359

[56] References Cited

U.S. PATENT DOCUMENTS

| | | | |
|---|---|---|---|
| 1,472,686 | 10/1923 | Schwartz et al. | 362/359 |
| 2,834,873 | 5/1958 | Cooper | 362/226 |
| 3,382,355 | 5/1968 | Prifogle et al. | 362/95 |
| 4,164,209 | 8/1979 | Maguire, Jr. et al. | 362/226 |
| 4,774,641 | 9/1988 | Rice | 362/95 |
| 4,931,911 | 6/1990 | Hanson | 362/95 |
| 5,169,227 | 12/1992 | Korte et al. | 362/226 |

FOREIGN PATENT DOCUMENTS

| | | | |
|---|---|---|---|
| 112198 | 12/1940 | Australia | 362/359 |

*Primary Examiner*—Richard R. Cole

*Attorney, Agent, or Firm*—Morton J. Rosenberg; David I. Klein

[57] ABSTRACT

The socket/tab supported light fixture preferably incorporates a fluorescent lamp within an elongated housing that has projecting blades to be received in an electrical wall socket. The housing incorporates a tab extending to overlie the face plate screw of the wall socket, the tab including an opening to receive the face plate screw thereby to attach the light fixture to the wall socket. The light fixture also preferably includes an elongated pivoting shade that may be moved to adjust the illumination level provided by the light fixture to at least a portion of the illuminated area.

16 Claims, 2 Drawing Sheets

SOCKET/TAB SUPPORTED LIGHT FIXTURE

The present invention relates to an electric light fixture, particularly a socket supported light fixture.

A great many different light fixtures have been designed to receive and support one or more electric light bulbs or fluorescent light tubes. Some of these fixtures are intended for use with the fluorescent light bulbs; others are designed to be supported on an electrical wall socket and to provide a low level of illumination. They are commonly called "night lights." One fluorescent style night light is characterized by an elongated housing that encloses a transparent or semitransparent full cover over the bulb to shield the voltages applied to the bulb from accidental encounter by a person. Fluorescent night lights produce a given level of illumination. In some applications, it may be desired to reduce this illumination.

All night lights include a pair of blades intended to be received in a typical household wall socket and to connect the source of electrical power at that socket to the bulb within the fixture; support the bulb and its housing. Customarily light fixtures are located a foot or two above the floor and can be easily reached by small children. If they begin to remove the night light from the electrical wall socket, it is possible for the child to withdraw the night light from the socket somewhat, while the blades are still electrically engaged in the socket. If the child then sticks a finger between the night light and the wall socket, the child may touch the blades and be injured by the substantial electrical voltages which exist on them.

One object of the present invention is to provide a night light, particularly a fluorescent style night light, with a simple and effective structure to permit the level of illumination it provides to be adjusted or reduced selectively. Another object of the present invention is to provide a night light that impedes its partial removal by small child and the accidental shocking of that child. Another object of the present invention is to provide a simple structural support to the light other than the natural support from the plug blades which is received by conventional plug in lights. In certain instances where more than one small lamp is used or larger lamps are employed, the plug blades may not support the entire fixture because of the heavy ballast weight and or the large physical size of the unit. These and other objects of the present invention will be apparent to those skilled in this field from the following description of a preferred embodiment.

BRIEF DESCRIPTION OF THE INVENTION

The present invention provides a socket supported light fixture that includes an elongated housing and a fluorescent lamp received within the housing. Electrical control means also received within the housing are connected to the lamp to supply power to it. An electrical connector is also provided within the housing, and is mounted to be supported by the housing. By plugging this electrical connector into an electrical wall socket, it is possible to both support the housing on the wall socket and to provide electrical power to the electrical control means.

The housing includes attachment means to impede the removal of the connector from the wall socket, and provide means to support the fixture from the outlet wall. Preferably this attachment means physically attaches the housing to the wall socket such as by screwing the housing itself to the wall socket. For example, the attachment means may include a tab projecting from the housing to abut the face of the wall socket over its face plate, the tab overlying the central screw attaching the face plate to the wall electrical socket fixture. The face plate screw may be removed and reinserted through an opening in the tab, or another screw used to physically attach both the tab (and thereby the housing) and the face plate to the wall socket.

The socket mounted light fixture preferably also includes an adjustable shade affixed to the housing to overlie the fluorescent lamp and, by adjusting the shade, to vary the illumination provided by the light fixture. This shade may be pivotedly attached to the housing, and preferably includes structure to hold the shade in any of multiple positions relative to the housing.

BRIEF DESCRIPTION OF THE DRAWINGS

The invention will be further described in connection with the accompanying drawings in which.

DETAILED DESCRIPTION

The socket/tab supported light fixture of the present invention includes two basic, cooperating features: (1) an attachment mechanism to support the fixture and impede or prevent its unintended removal from a wall socket, such as by a small child, and (2) a removable shade that may be employed to selectively adjust the level of illumination provided by the light fixture to an area. In the light fixture of the present invention, these features are employed together in a structure intended to receive and support a fluorescent bulb. Of course, either could be used independently of the other, and in fixtures of different designs and styles.

Figure 1:
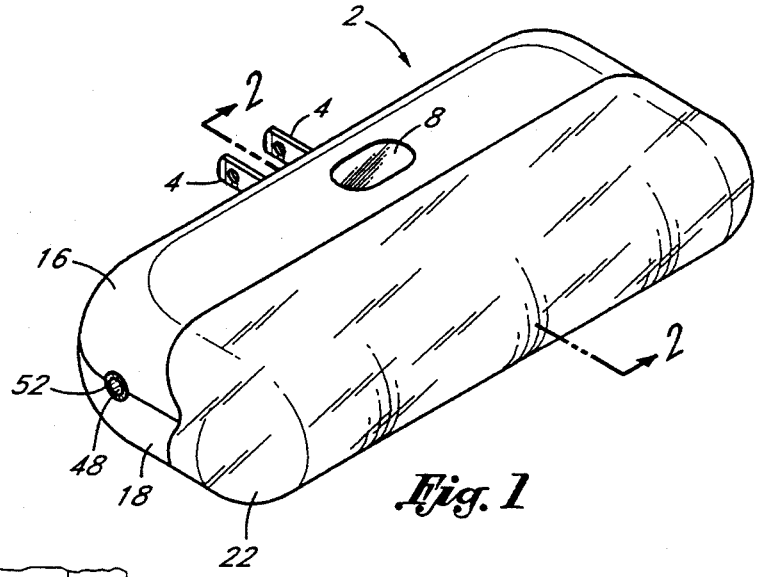
FIG. 1 is a perspective view of a preferred embodiment of the socket supported light fixture.
Figure 2:
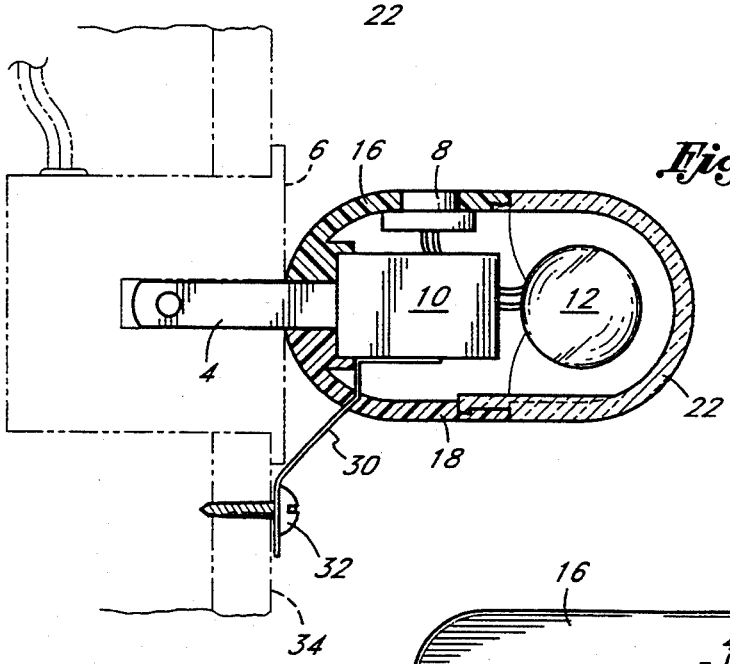
FIG. 2 is a cross sectional view of the light fixture taken on lines II—II of FIG. 1 showing the fixture supported by a wall socket.

As shown in FIG. 1, the socket/tab supported light fixture includes a housing 2 that has, projecting from its rear surface, a pair of electrical connector blades 4. As shown in FIG. 2, these blades are physically attached to the housing and may be inserted in an electrical wall socket 6, thereby to support the light fixture. As will be shown, such support can be enhanced with the use of additional structure.

The fixture includes a switch 8 that may be actuated to apply power from blades 4 through an appropriate electrical control means 10 received within the housing to an elongated fluorescent light bulb 12 (shown in FIG. 2) also received within the housing, thereby to illuminate the area around the fixture.

Figure 3:
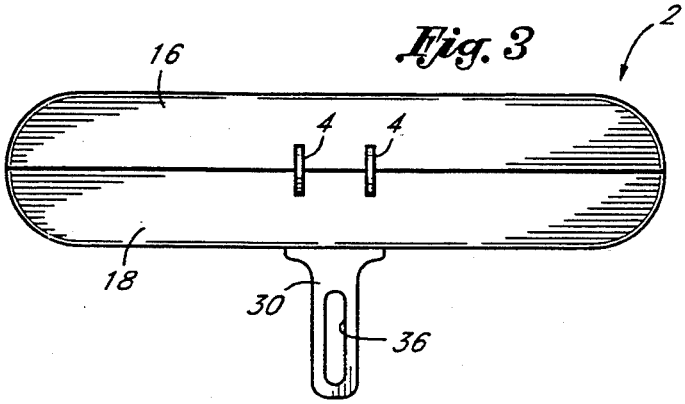
FIG. 3 is a front view of the housing shown in FIG. 1.
Figure 4:
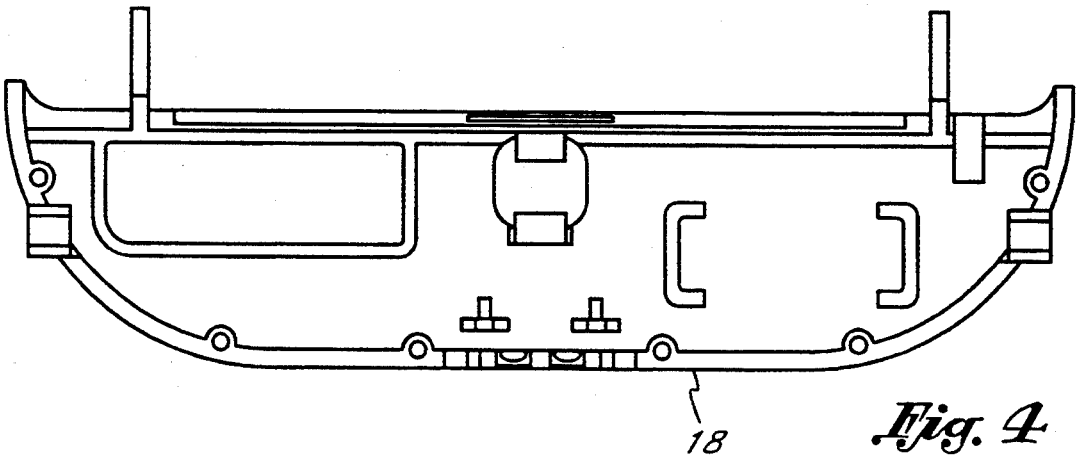
FIG. 4 is an elevational view of one of the housing shell halves shown in FIG. 3.

Preferably the housing 2 is made in three mating parts, as shown in FIGS. 2 and 3, an upper shell portion 16, a lower shell portion 18, and a translucent cover 22. Along the margins of the mating upper and lower shell portions is included a series of mating indentations and projections that preferably align and interlock the shell halves. One of the shell halves is shown in elevation in FIG. 4. It includes appropriate interior brackets and structures to locate, receive and support the various elements of the electrical control means, and to support the fluorescent lamp as well.

Figure 5:
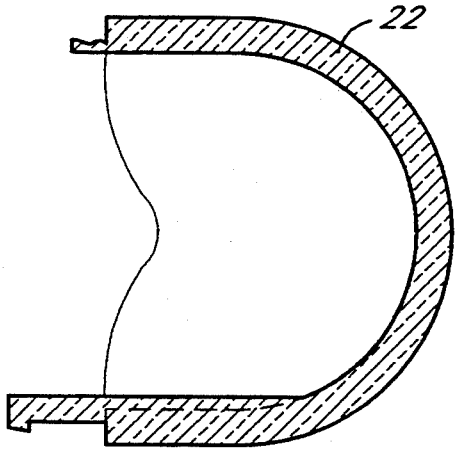
FIG. 5 is an enlarged cross-sectional view of the semitransparent cover portion of the housing shown in FIG. 2.

The translucent cover 22, shown in perspective in FIG. 1 and in cross section in FIGS. 2 and 5, interfits with the shell halves thereby to provide a smooth, complete housing presenting a sleek, coherent appearance. Translucent cover 22 also includes projections and indentations along its margins that interfit with mating projections and indentations of the shell halves to align and secure the translucent cover to the shell halves and hold the assembly together.

As shown in FIGS. 2 and 3, the light fixture housing 2 includes a tab 30 that extends from the housing to overlie the screw 32 attaching the cover plate 34 to wall socket 6. Tab 30 incorporates an opening overlying screw 32. By first removing screw 32 before the blades of the light fixture are inserted into the wall socket then, after the blades are fully inserted to the wall socket, rethreading screw 32 through the opening 36 in tab 30, and through plate 34 into the wall socket, the light fixture may be fixed in a secure manner to the wall socket. This, in addition to supporting the light fixture, prevents the light fixture from being partially removed from the wall socket simply by pulling at the light fixture, thereby to prevent the accidental shocking of a small child fiddling with the light fixture. Preferably opening 36 of tab 30 is shaped as a slot to receive screw 32 of any of various types of wall fixtures, thereby to adapt this safety feature of the housing to general application to all common wall fixture designs.

It will be noted that the fixture is shown inserted in the upper wall socket in FIG. 2. Those familiar with wall sockets know that conventionally they incorporate two receptacles (an upper and lower receptacle). The present housing design, by virtue of the placement of switch 8 and tab 30, is intended to be inserted into the upper wall socket. However, it also may be inserted in the lower socket simply by rotating it 180 degrees, the switch then being on the bottom of the housing and tab 30 projecting upwards from the housing to receive screw 32 (which is conventionally centrally located relative to the wall plate and wall socket).

Figure 6:
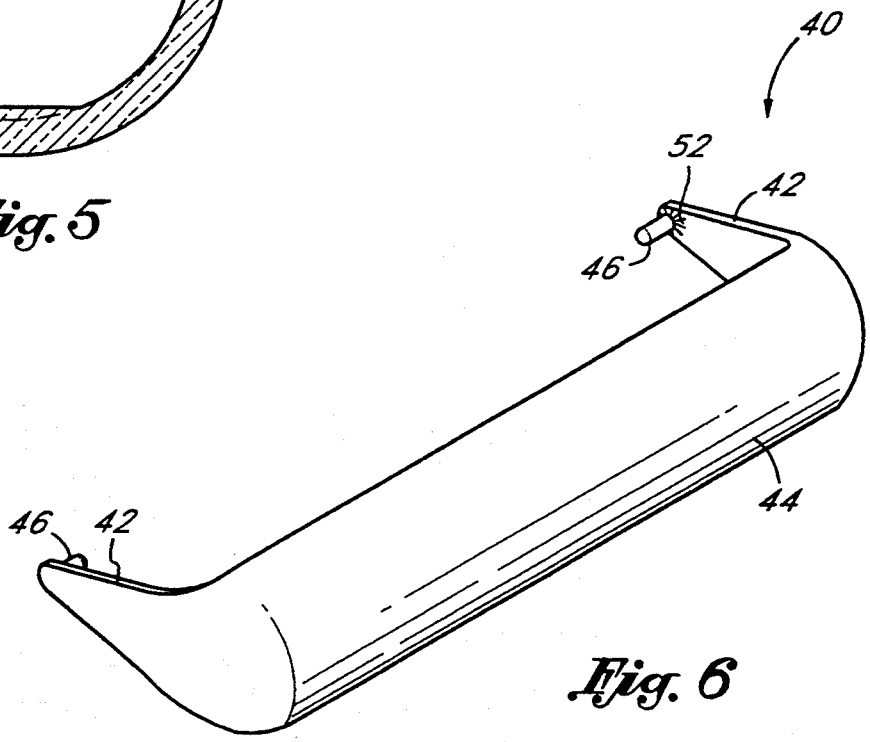
FIG. 6 is a perspective view of a shade which may be incorporated with the light fixture shown in FIG. 1.

The light fixture of the present invention also preferably includes a shade to at least partially cover or overlie translucent cover 22 thereby to permit adjustment of the illumination level provided by the light fixture. This shade is shown in FIG. 6. In it, shade 40 includes a pair of projecting arms 42 each extending from a central, semi-cylindrical central portion 44. As shown in FIG. 2, the semi-cylindrical central portion is shaped to overlie translucent cover 22. Arms 42 each include opposed projecting pins 46 that are received in sockets 48 provided by the half-shells of the housing. Thus, shade 40 may be manually moved to pivot relative to the translucent cover 22 to cause central portion 44 to overlie some or all of the upper half of the translucent cover. Preferably shade 40, or at least its central portion 44, is significantly more opaque than translucent cover 22. Thus, as it moves down over the translucent cover, the level of illumination in at least one-half of the field illuminated by the fixture is reduced significantly. Typically, the light fixture will be mounted as shown in FIG. 2 and shade 40 used to reduce the illumination in the upper half of the room in which the wall socket is located.

Socket 48, and the abutting portion of arm 42 adjacent to pin 46, preferably includes a series of mating ridges 52 to hold the shade in any of various angular positions relative to housing 2 and its translucent cover. Of course, by deflecting arms 42 pins 46 may be removed from sockets 48 if it is desired to not employ shade 40, or to reverse the shade in the housing.

While a preferred construction of the light fixture has been shown and described, since those skilled in this field may prefer different constructions, the invention is not defined by the preferred embodiment herein disclosed but rather is as set forth in the following claims.

What is claimed is:

1. A socket/tab supported light fixture including
a housing;
a lamp received within the housing;
electrical control means received within the housing to apply electrical power to the lamp, the electrical control means including electrical connector blades supported by the housing and projecting from the housing spaced to permit the connector blades to be plugged into an electrical wall socket thereby to apply a source of electrical power to the electrical control means; and
attachment means to impede removal of the connector blades from the wall socket, said attachment means extending through a wall of said housing having a first end section in contiguous contact with a lower surface of said electrical control means for support of said electrical control means within said 2. A light fixture as set forth in claim 1 in which the attachment means include means for fixing the housing to said wall socket at a second end section of said attachment means.

3. A light fixture as set forth in claim 2 in which the attachment means include an attachment screw for fixing the housing to a the wall socket.

4. A light fixture as set forth in claim 3 in which the attachment means include a tab projecting from through the housing, the tab being located to abut the face of a wall socket over the plate screw attaching the face plate of the wall socket to the wall socket, the plate screw constituting the attachment screw.

5. A light fixture as set forth in claim 4 in which the tab is shaped to receive the plate screw over a range of spacings from the plug of the wall socket.

6. A light fixture as set forth in claim 5 in which the tab includes an elongated slot to receive the attachment screw.

7. A socket/tab supported light fixture including an elongated housing forming a closed interior chamber, a section of said housing being translucent; a fluorescent lamp received within the housing for emitting light through said housing translucent section;
electrical control means received within the housing to apply electrical power to the lamp, the electrical control means including electrical connector blades supported by the housing and projecting from the housing spaced to permit the connector blades to be plugged into an electrical wall socket thereby to apply a source of electrical power to the electrical control means and
an elongated adjustable shade affixed to the housing to overlie the elongated housing and, by adjusting the shade over said housing translucent section, to vary the illumination provided by the light fixture.

8. A light fixture as set forth in claim 7 in which the shade is pivotedly attached to the housing and is adjustable by pivoting the shade relative to the housing.

9. A light fixture as set forth in claim 8 including means to hold the shade in any of multiple positions relative to the housing.

10. A light fixture as set forth in claim 8 in which the housing includes a fixture at each of its two ends, and in which the elongated shade includes fixtures at its two ends, the housing and shade fixtures mating with one another to pivotally connect the shade to the housing.

11. A light fixture as set forth in claim 8 in which the shade may be pivoted to vary the illumination provided by the fluorescent lamp to the upper portion of the illuminated area.

12. A light fixture as set forth in claim 8 including attachment means to impede the removal of the connector blades from the wall socket.

13. A light fixture as set forth in claim 12 in which the attachment means include means for fixing the housing to the wall socket.

14. A light fixture as set forth in claim 13 in which the attachment means include a tab projecting from the housing, the tab being located to abut the face of a wall socket over the plate screw attaching the face plate of the wall socket to the wall socket, the plate screw constituting the attachment screw.

15. A light fixture as set forth in claim 14 in which the tab is shaped to receive the plate screw over a range of spacings from the plug of the wall socket.

16. A light fixture as set forth in claim 15 in which the shade may be pivoted to vary the illumination provided by the fluorescent lamp to the upper portion of the illuminated area and including means to hold the shade in any of multiple positions relative to the housing.

* * * * *